United States Patent [19]

Corda

[11] 4,079,471

[45] Mar. 21, 1978

[54] HINGE ASSEMBLY FOR TOILET SEATS AND OTHER ARTICLES

[76] Inventor: Joseph Corda, 211-16 93rd Ave., Bellaire, N.Y. 11428

[21] Appl. No.: 682,379

[22] Filed: May 3, 1976

[51] Int. Cl.[2] ..... A47K 13/12

[52] U.S. Cl. ..... 4/240; 4/236

[58] Field of Search ..... 4/236, 240, 234, 239; 16/38

[56] References Cited

U.S. PATENT DOCUMENTS

| | | | |
|---|---|---|---|
| 558,931 | 4/1896 | Buick | 4/236 |
| 1,429,513 | 9/1922 | Leslie | 4/236 |
| 1,559,283 | 10/1925 | Schlegel | 4/236 |
| 1,693,915 | 6/1928 | Lowe | 4/236 |
| 2,901,753 | 9/1959 | Sperzel | 4/240 |
| 3,046,570 | 7/1962 | Young | 4/240 |
| 3,080,572 | 3/1963 | Miller et al. | 4/240 |
| 3,613,130 | 10/1971 | Sansone | 4/240 |

FOREIGN PATENT DOCUMENTS

| | | | |
|---|---|---|---|
| 769,337 | 10/1967 | Canada | 4/240 |

*Primary Examiner*—Henry K. Artis
*Attorney, Agent, or Firm*—Jacob L. Kollin

[57] ABSTRACT

A hinge assembly for toilet bowl seat covers and other objects. The assembly comprises a pair of posts spacedly secured to a flange of the toilet bowl. The posts have upper smooth portions extending from the flange. A pair of bushings provided with hollow ears are pressed on the upper smooth portions of the posts. A hinge rod is passed through the hollow ears and through hinges secured to the toilet seat and cover.

1 Claim, 5 Drawing Figures

HINGE ASSEMBLY FOR TOILET SEATS AND OTHER ARTICLES

This invention relates to easily replaceable hinges in general and to a hinge assembly for toilet bowl seats and covers.

The installation and replacement of seat covers and seats on toilet bowls is time consuming, inconvenient and requires appropriate tools. Particularly, the home owner or the housewife, even a plumber have to kneel down to perform the work in usually tight quarters.

It is an object of this invention, to overcome these disadvantages by providing a hinge which is easily, quickly and conveniently assembled, requires no tools on the part of a householder, housewife or plumber, which is sturdy in construction and is economical to manufacture.

The hinge construction is not limited to use with toilet seats, but may be used with various other objects, such as furniture, containers and the like.

These and other objects of the invention will become apparent from the following description in connection with the appended drawing illustrating a preferred embodiment of the invention. It is to be understood, however, that these are given by way of illustration and not of limitation and that changes may be made in the detail, construction, form and size of the parts, without affecting the scope of the invention sought to be protected.

In the drawing

Figure 1:
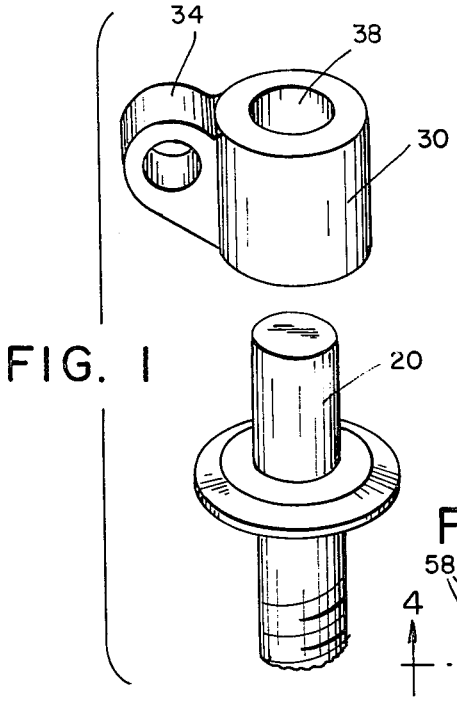
FIG. 1 is an exploded perspective view of the hinge assembly made in accordance with one form of the present invention.
Figure 2:
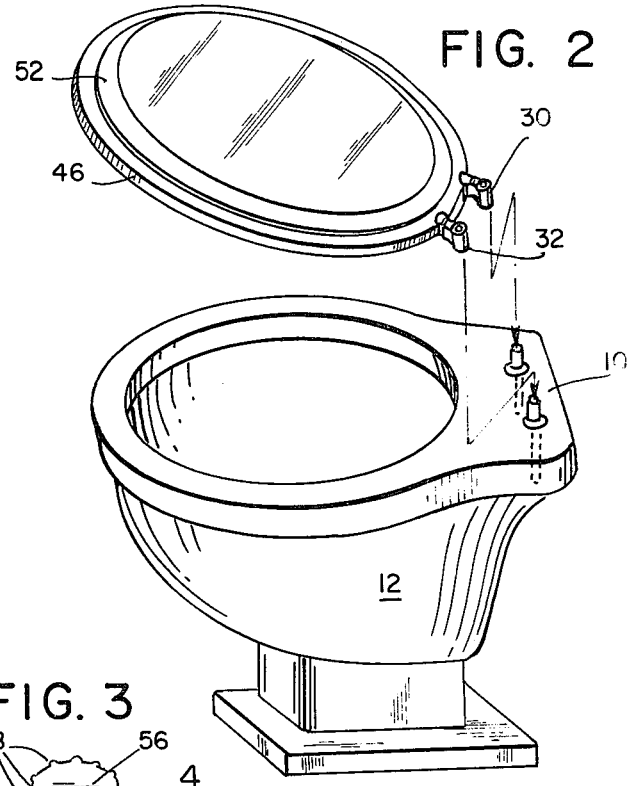
FIG. 2 is an exploded perspective view showing the manner of assembling the hinge on a toilet bowl seat and cover.
Figure 3:
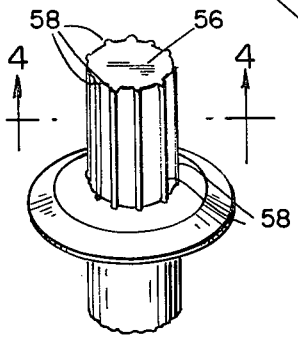
FIG. 3 illustrates, in perspective, a post used in a modified form of the invention.
Figure 4:
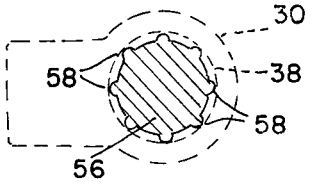
FIG. 4 is a cross-section taken on line 4—4 of FIG. 3 and showing the bushing in phantom line.

Referring now to the drawing in detail, there is shown one of a pair of posts 6,8, secured to the mounting flange 10 of a toilet bowl 12. The posts are provided with integral washers 14,15, threaded lower end portions 16, 18 and smooth upper end portions 20, 22. The posts are first secured to the toilet bowl flange 10, as shown in FIG. 2, by passing the threaded portions 16,18 through respective holes (not shown) in the bowl flange and screwing on the nuts 24,26 on threaded portions 16,18 of the posts.

Figure 5:
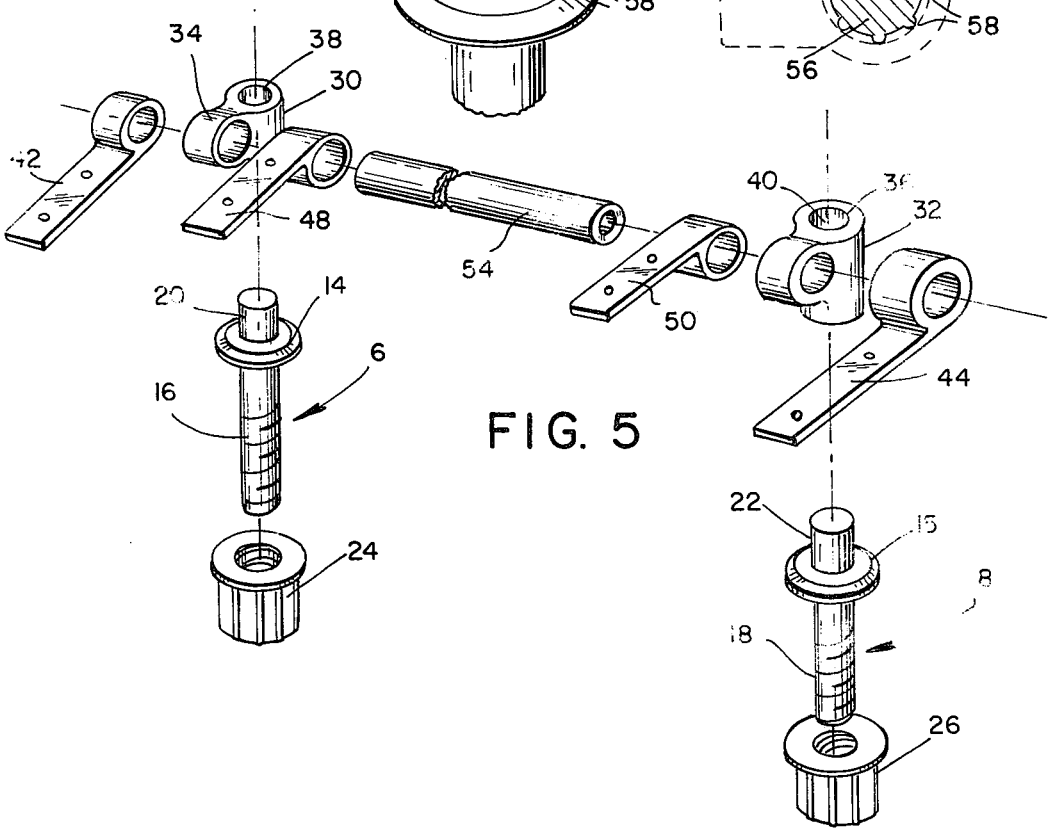
FIG. 5 is an exploded view of the complete assembly according to the invention.

In manufacturing the hinge assembly, shown in FIG. 5, comprising the above described posts and nuts is installed in the following manner.

The posts 16,18 are first secured to the bowl flange, as described above. Bushings 30,32 provided with ears 34,36, and having interior walls 38,40 with close tolerances relative the walls of the upper portions 20,22, of the posts 6,8 are hand pressed on said upper portions of the posts. A pair of hinges 42,44 are spacedly secured to the bottom of a toilet seat 46 between bushings 30,32 respectively. A second pair of hinges 48,50 are secured to the cover 52 intermediate bushings 30,32. A rod 54 is passed through the hinges and the bushing ears, thus forming the entire hinge.

In another version of the invention, employing plastic material, a pair of posts, such as post 56 are formed with ridges 58 which are sufficiently compressible to allow the posts to be inserted in the bushings, such as 30 and are expandable after their insertion to form a tight fit with the interior wall, such as 38, 62 of said bushing.

I claim:

1. A hinge assembly for toilet seats, for attachment to a toilet bowl having a toilet bowl mounting flange, said toilet bowl mounting flange having a pair of apertures extending therethrough, one on each side thereof comprising, in combination, a pair of spaced apart hinge posts secured to and said toilet bowl mounting flange through said aperatures, each of said hinge posts having a lower threaded portion extending through and below said toilet bowl mounting flange, a smooth upper portion extending above the toilet flange, a washer integral therewith, spaced a predetermined distance from the top thereof above said toilet bowl mounting flange and disposed on the surface of said toilet bowl mounting flange and a pair of nuts in threaded engagement with said lower threaded portions, respectively for securing the posts to said toilet bowl mounting flange, a pair of bushings formed with bores extending therethrough to mate with said smooth upper portions of said hinge posts, for slidable engagement therewith, said bushings being provided with apertured ears, a plurality of hinge elements securable to a toilet seat and a rod extending through said hinge elements and through the apertures in said ears.

* * * * *